US008153050B2

(12) United States Patent
Sheng

(10) Patent No.: US 8,153,050 B2
(45) Date of Patent: Apr. 10, 2012

(54) DEVICE FOR IMPLEMENTING A HIGH EFFICIENCY METHOD OF SCOOPING-UP SLAG FROM LIQUID IRON

(76) Inventor: Fuchun Sheng, Shandong (CN)

( * ) Notice: Subject to any disclaimer, the term of this patent is extended or adjusted under 35 U.S.C. 154(b) by 1000 days.

(21) Appl. No.: 10/582,864

(22) PCT Filed: Apr. 5, 2004

(86) PCT No.: PCT/CN2004/000308

§ 371 (c)(1),
(2), (4) Date: Jun. 4, 2009

(87) PCT Pub. No.: WO2005/056840

PCT Pub. Date: Jun. 23, 2005

(65) Prior Publication Data

US 2009/0293677 A1 Dec. 3, 2009

(30) Foreign Application Priority Data

Dec. 15, 2003 (CN) ..... 2003 1 0121101

(51) Int. Cl.
*C21B 3/00* (2006.01)

(52) U.S. Cl. ..... 266/228; 266/143; 266/165; 266/276

(58) Field of Classification Search ..... 266/228, 266/143, 165, 276
See application file for complete search history.

(56) References Cited

U.S. PATENT DOCUMENTS

| | | | | |
|---|---|---|---|---|
| 4,153,965 A | | 5/1979 | Merly et al. | |
| 5,360,204 A | * | 11/1994 | Mancuso | 266/226 |

FOREIGN PATENT DOCUMENTS

| | | | | |
|---|---|---|---|---|
| CN | 1225300 A | | | 8/1999 |
| CN | 2381419 Y | | | 6/2000 |
| JP | 02130389 A | | * | 5/1990 |
| JP | 10-005988 A | | | 1/1998 |
| JP | 2000227282 A | | * | 8/2000 |
| WO | WO-99/60177 A1 | | | 11/1999 |

OTHER PUBLICATIONS

Qin Xizhu et al., Iron Alloy, 1995 (2), p. 32-33.

* cited by examiner

*Primary Examiner* — George Wyszomierski
*Assistant Examiner* — Tima M McGuthry Banks
(74) *Attorney, Agent, or Firm* — Birch, Stewart, Kolasch & Birch, LLP

(57) ABSTRACT

The present invention provides a method of high efficient slag scooping-up from liquid iron and a device for implementing said method. The two wings of slag rake mounted to the front end of cantilever descend side by side until beneath the surface of the liquid iron at a certain depth. The two rakes make swing movement respectively along the surface of liquid iron. When gradually moving close to each other in the course of swing movement, they get put together and clamp the solid slag. Then, driven by the cantilever, the two slag rakes which clamp the sold slag are brought to ascend until above the surface at a certain height. Finally they leave the space over the ladle and discharge the slag. The deslagging rate can reach over 90%. It just takes less than 3 minutes for the whole process of slagging-off. Additionally, the iron carried away in the process of slagging-off could be greatly reduced. The iron loss rate can be strictly controlled within 0.1%.

6 Claims, 1 Drawing Sheet

DEVICE FOR IMPLEMENTING A HIGH EFFICIENCY METHOD OF SCOOPING-UP SLAG FROM LIQUID IRON

CROSS-REFERENCE TO RELATED APPLICATION

The present application is a National Stage of PCT/CN2004/000308 filed Apr. 5, 2004 and claims priority under 35 U.S.C. §119 to Chinese Patent Application No. 200310121101.6 filed Dec. 15, 2003.

TECHNICAL FIELD OF THE INVENTION

The present invention generally relates to the field of smelting technology. More particularly, it relates to a method of high efficient dross removal from the surface of liquid iron and a device for implementing the process of slagging-off for the liquid iron by means of the aforesaid method.

BACKGROUND OF THE INVENTION

After the pre-treatment of desulfurization, desiliconization and dephosphorization, the liquid iron will produce a great amount of solid slag which float on its surface. The solid slag must be removed away promptly. Otherwise it may impair the pre-treatment effect for the liquid iron, leading to the rise in production cost of the next processes.

The existing slagging-off device in the process of pre-treatment of liquid iron has been used since the 1950s or 1960s. This kind of slagging-off machine for liquid iron is of linear reciprocating type, driven mechanically or hydraulically. A slag rake, which is made of refractory material, is mounted on a cantilever of the machine. By immersing the rake into the liquid iron to a certain depth and making it moving along the surface of liquid iron in linear or curved reciprocating manner, it can rake out the solid slag floating on the surface of liquid iron in the ladle gradually.

However, the conventional slagging-off technique and the equipment have disadvantages as follows: (1) Long time taking for the work of slagging-off and low working efficiency. Normally, it would need to reciprocate for over ten or even tens of times, which takes 5 to 10 minutes; (2) Incomplete deslagging and low deslagging rate. By adding slag adhesive agent or slagging-off agent so as to conglomerate the slag, the deslagging rate can just reach 80% to its maximum. The incomplete deslagging would directly bring about much more resulfurization in converter or electric furnace; (3) Liable to carry away liquid iron while raking out slag, generally with an iron loss between 0.5% and 1.0%. These problems have already become the worldwide problems that trouble the international iron and steel industry and constrain the development in this field. The direct economic loss incurred thereof is over 0.5 billion US dollars each year.

Over the recent years, rapid development has seen in China's iron and steel industry, with an overall yield reaching the first place in the world. It was estimated that pretreatment amount of liquid iron could reach 50 million tons in 2003. But, as the technology and equipment are relatively backward, the actual iron loss rate is mostly around 1.0%. Together with the economic loss caused by resulfurization in converter and electric furnace, the direct economic loss a year would be over 0.5 billion RMB.

DISCLOSURE OF THE INVENTION

In order to overcome the disadvantages of the existing method and equipment for the process of slagging-off for liquid Iron as mentioned above, the present invention is to provide a new and high efficient slagging-off method and a device for implementing said method. The swing movement is adopted in the slagging-off technology in the present application. It makes the process more speedy and efficient, and reduces the iron loss significantly.

The method of high efficient slagging-off for liquid iron of the present invention is described as follows: The two wings of slag rake mounted to the front end of cantilever makes swing movement respectively along the surface of liquid iron. When gradually moving close to each other, they get put together and clamp the solid slag. Then, driven by the cantilever, the two slag rakes move back to the vicinity of the edge of the liquid iron ladle and discharge the slag.

First, the two slag rakes descend side by side until beneath the surface of the liquid iron at a certain depth. Then after the swing movement, they are brought to ascend by the cantilever until above the surface at a certain height. Finally, the two slag rakes are driven by the cantilever to move to the outside of the edge of liquid iron ladle and discharge the slag.

A device for implementing the aforesaid high efficient method of slagging-off for liquid iron, comprising a flatcar track, a flatcar which reciprocates along the flatcar track and a cantilever which is connected to the flatcar by means of a hoisting main shaft. The rack is fitted in the drive case at the front end of the cantilever. It is engaged with the gears on its two sides. The two gears are fixed to the rear ends of two slag rakes by means of two rotating shafts.

There is an oil cylinder connected to the rear end of the rack. It drives the rack to move forward or backward. The flatcar is driven by a motor or hydraulic power to move along the flatcar track. One side of each of the two slag rakes which gathers and clamps slag is in saw-tooth shape.

Comparing the existing slagging-off technology and equipment, the present invention has the following advantages: (1) The deslagging rate increased obviously. If the slag amount is not much, just one swing motion of the two slag rakes will rake out over 90% of the slag. And if the slag amount is much, over 90% of slag can be raked out after two or three swing motions; (2) The speed for the process of slagging-off increased greatly. It just takes less than 3 minutes for the whole process of slagging-off; (3) At the final stage of the slagging-off process, the slag rakes ascend and leaves away from the surface of the liquid iron. It makes the liquid iron left in the rakes flow back mostly to the ladle. Accordingly, the iron loss can be greatly decreased in the slagging-off process, with the loss rate being strictly controlled within 0.1%.

DETAILED DESCRIPTION OF THE PREFERRED EMBODIMENT

Figure 1:
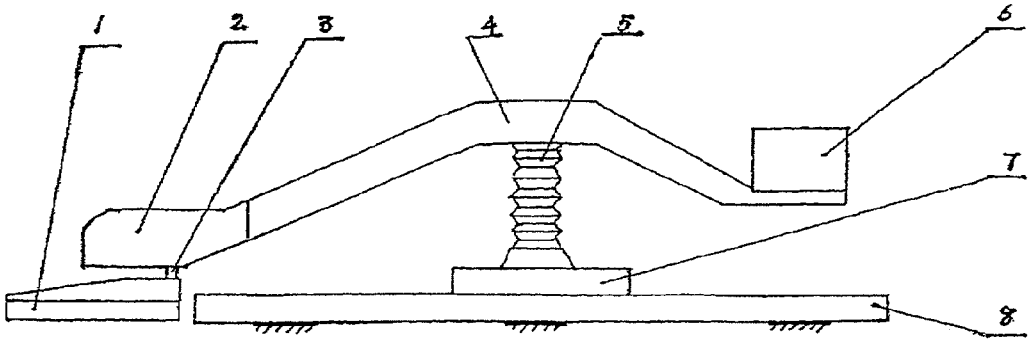
FIG. 1 is a structural schematic diagram of the device for slagging-off of the present invention.
Figure 2:
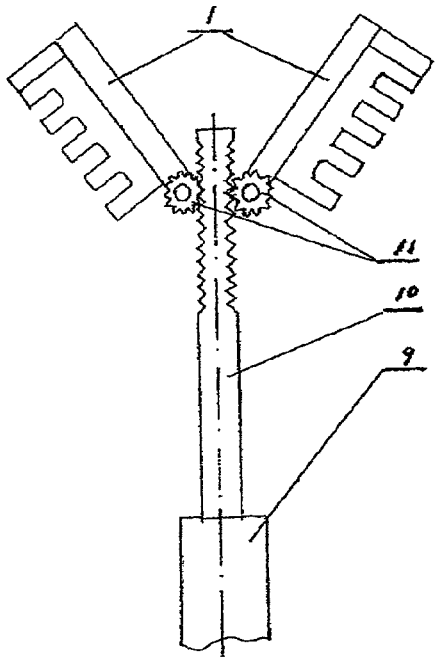
FIG. 2 is a structural schematic diagram of the driving mechanism of the slag rake.

The prevent invention will be more clearly understood by the detailed description of the process of slagging-off that follows herein, which can be taken as one of the preferred embodiments of the high efficient slagging-off method of the present invention.

(1) When the liquid iron ladle moves in and takes its working position, the flatcar, driven by a motor or hydraulic power, moves forward to appropriate working position for the process of slagging-off;

(2) The hoisting main shaft (oil cylinder) starts to operate. It brings the slag rakes down into the liquid iron and beneath the surface at 20 to 50 mm by means of a cantilever;

(3) Hydraulically driven by the oil cylinder, the slag rakes make swing movement for collecting slag;

(4) When the two slag rakes move to the edge of liquid iron ladle, the hoisting main shaft (oil cylinder) lifts up the cantilever, which brings the slag rakes up and above the surface at 30 to 100 mm;

(5) Driven by the motor or hydraulic power, the flatcar starts to move backward until to the position where the slag rakes completely leave the space over the liquid iron ladle;

(6) The two slag rakes swing in a reversed way respectively so as to make the slag in the rakes fall down into the slag hopper in the vicinity of the ladle.

The device for implementing the process of slagging-off for the present invention become apparent from the following more detailed description, which is only one of the embodiments to implement the aforesaid method. In fact, the method of the present invention can generate many variants of slagging-off equipment of different types of structures.

The device for implementing the process of slagging-off of the present invention comprises a flatcar track 8, a flatcar 7 reciprocating on the track 8 and a cantilever 4 connected to the flatcar 7 by means of a hoisting main shaft (oil cylinder) 5. The rack 10 is fitted at the front end of the cantilever 4. The rack is engaged with the gears 11 on its two sides. The two gears 11 are fixed to the rear ends of two slag rakes 1 by means of the two rotating shafts 3. The said slag rakes 1 can be made of refractory material or other materials.

There is an oil cylinder 9 connected to the rear end of the rack 10. It drives the rack 10 to move forward or backward. The slag rakes 1 are driven to make swing movement by means of the gears 11 and rotating shaft 3. Practically, there are many ways to drive the slag rakes to make swing movement, one of which is rack and gear method. Other driving methods could be of gear, cam, worm and worm gear, chain, belt, oscillating oil cylinder or any other hydraulic or electric driving types.

The flatcar 7 can be driven to move on the flatcar track 8 either by a motor or by chain mechanism of a hoist. It can also be driven by its own power of the flatcar.

One side of each of the two slag rakes which gathers and clamps slag is in saw-tooth shape, which make it easy for collecting and clamping the slag.

The hydraulic system (oil pump and oil tank) 6 can be fixed to the rear end of the cantilever.

Additionally, the cantilever 4 can be designed to be of hydraulic driven type as requested by customer. The flatcar 7 can be driven electrically to ensure the accurate position and the automatic control of the whole process.

What is claimed is:

1. A device for implementing a high efficiency method scooping-up slag from liquid iron, comprising:

a flatcar track (8), a flatcar (7) which reciprocates along the flatcar track (8), and a cantilever (4) which is connected to the flatcar (7) by means of a hoisting main shaft (5), a rack (10) fitted in a drive case (2) at a front end of the cantilever (4), two gears (11) engaged with the rack (10) on two sides thereof, wherein the two gears (11) are fixed to rear ends of two slag rakes (1) by means of two rotating shafts (3), and wherein the two slag rakes (1) are adapted to swing toward each other in order to clamp and scoop-up the slag.

2. A device for implementing a high efficiency method of slag scooping-up from liquid iron according to claim 1, further comprising:

an oil cylinder (9) connected to a rear end of the rack (10), the oil cylinder (9) being adapted to move the rack (10) forward or backward.

3. A device for implementing a high efficiency method of slag scooping-up from liquid iron according to claim 1, wherein the flatcar (7) is driven by a motor to move along the flatcar track (8).

4. A device for implementing a high efficiency method of slag scooping-up from liquid iron according to claim 1, wherein the flatcar (7) is driven by hydraulic power to move along the flatcar track (8).

5. A device for implementing a high efficiency method of slag scooping-up from liquid iron according to claim 1, wherein one side of each of the two slag rakes (1) which gathers and clamps the slag has a saw-tooth shape.

6. A device for implementing a high efficiency method of slag scooping-up from liquid iron according to claim 1, wherein the cantilever is a hydraulic driven-type cantilever.

* * * * *